US006964712B2

(12) United States Patent
Wigger et al.

(10) Patent No.: US 6,964,712 B2
(45) Date of Patent: Nov. 15, 2005

(54) HARDENING PROTECTION COMPOSITIONS FOR PARTIAL CARBURIZATION OF METALLIC COMPONENTS

(75) Inventors: Stefan Wigger, Hanau (DE); Ulrich Baudis, Alzenau (DE)

(73) Assignee: Durferrit GmbH, Mannheim (DE)

( * ) Notice: Subject to any disclaimer, the term of this patent is extended or adjusted under 35 U.S.C. 154(b) by 0 days.

(21) Appl. No.: 09/922,948

(22) Filed: Aug. 7, 2001

(65) Prior Publication Data

US 2002/0020471 A1 Feb. 21, 2002

(30) Foreign Application Priority Data

Aug. 7, 2000 (DE) ..... 100 38 447

(51) Int. Cl.[7] ..... C23C 8/04; C09D 1/02

(52) U.S. Cl. ..... 148/214; 148/210; 148/213; 106/628; 106/801; 106/815

(58) Field of Search ..... 148/210, 214, 148/213; 105/628, 801, 815, 286.6; 427/300; 106/628, 801, 815, 286.6

(56) References Cited

U.S. PATENT DOCUMENTS

| | | | | | |
|---|---|---|---|---|---|
| 1,629,072 | A | * | 5/1927 | Danielson | 148/22 |
| 1,921,367 | A | * | 8/1933 | Mahin | 148/225 |
| 2,196,232 | A | * | 4/1940 | Sweeney | 106/287.17 |
| 2,398,809 | A | * | 4/1946 | Snyder | 148/214 |
| 3,151,002 | A | | 9/1964 | Benz | |
| 3,180,765 | A | * | 4/1965 | Murray et al. | 148/214 |
| 3,873,376 | A | * | 3/1975 | Ritzka | 148/213 |
| 3,989,622 | A | * | 11/1976 | Marantz et al. | 210/645 |
| 4,102,838 | A | | 7/1978 | Scales | |
| 4,326,976 | A | * | 4/1982 | Logan et al. | 510/375 |
| 5,330,813 | A | * | 7/1994 | Hirooka et al. | 148/206 |
| 5,334,417 | A | * | 8/1994 | Rafferty et al. | 427/253 |
| 5,366,765 | A | * | 11/1994 | Milaniak et al. | 427/229 |

FOREIGN PATENT DOCUMENTS

| | | | | | |
|---|---|---|---|---|---|
| AT | 170 617 | | | 3/1952 | |
| DE | 969 995 | | | 8/1958 | |
| DE | 1286869 | B | * | 1/1969 | |
| EP | 0 867 524 | A1 | | 9/1998 | |
| EP | 0419675 | B1 | * | 3/1999 | C23C 8/04 |
| GB | 1372113 | A | * | 10/1974 | C08F 45/00 |
| JP | 53-060810 | A | * | 5/1978 | C23C 11/12 |
| JP | 11-286620 | | * | 10/1999 | C09D 1/02 |
| JP | 11-286620 | A | * | 10/1999 | C09D 1/02 |
| JP | 2001-030086 | | * | 2/2001 | B23K 20/00 |

OTHER PUBLICATIONS

Derwent Acc. No. 2001-439873 for Bodyaev Yu et al, RU 2169633 C1, published Jun. 27, 2001.*

Derwent Acc. No. 2001-646019 for Choi, D. M., KR 314371 B, published Nov. 22, 2001 and KR 2001045077 A, published Jun. 5, 2001.*

"The Mineral Talc", http://www.luzenac.com/whatstalc.html, accessed on Dec. 17, 2002.*

A copy of German Office Action for counterpart appln. 100 38 447.1, dated May 28, 2001.

K.H. Illgner and E. Permklau, "Damage to Furnace Parts Through Foreign Matter That Enters With The Goods to be Heated Treated", Z. Werkst. Waermebeh. Fertigung 59 (2004), pp. 132-145.

* cited by examiner

*Primary Examiner*—Roy King
*Assistant Examiner*—Harry D. Wilkins, III
(74) *Attorney, Agent, or Firm*—Marina V. Schneller; Venable LLP

(57) ABSTRACT

Hardening protection compositions based on substances which form boron glass for partial carburization of metallic components, which contain magnesium-silicon compounds as an additive. These hardening protection compositions can be used very advantageously in processes for the partial carburization of metallic components and in particular are outstandingly suitable for vacuum carburization.

15 Claims, No Drawings

HARDENING PROTECTION COMPOSITIONS FOR PARTIAL CARBURIZATION OF METALLIC COMPONENTS

INTRODUCTION AND BACKGROUND

The present invention relates to hardening protection compositions for partial carburization of metallic components.

In the heat treatment process for surface hardening of metals, it is often necessary for components to be partly protected before the treatment process, such as carburization, nitrocarburization or nitriding, in order still to be able to carry out certain mechanical working steps later on in selected surface areas, or in order to be able to retain the original properties of the material, such as, for example, the ductility.

In addition to electroplating with copper or nickel, for a long time there has already been a wide range of lacquer-like protective compositions which are applied to the selected surface areas before carrying out the hardening treatment. In the case of partial carburization, protective composition based on water-glass or based on substances which form boron glass have proved themselves useful for protection against diffusing-in of carbon.

While the compositions based on water-glass can be purged only mechanically after the hardening operation by blasting the components with sand or glass beads etc., protective compositions based on substances which form boron glass have the great advantage of being able to be washed off with water. However, with the known hardening protection compositions based on substances which form boron glass, there is the risk of running off in the oven during the hardening operation, in particular after incomplete drying or due to binding of moisture from the atmosphere by the composition, since the viscosity of the boron components is greatly reduced by water at a high temperature.

Furthermore, at carburization temperatures of 900–980° C. the boron compound can vaporize until vapour pressure equilibrium is established. On the one hand this results in a decrease in the protective action due to the protective layer becoming thinner, and on the other hand an oven lining of $SiO_2$-containing bricks can also be attacked. In particular, because of the relatively high vapour pressure such compositions can be employed to only a limited extent in reduced pressure carburization, since damage to the reduced pressure carburization plant by vaporizing boron compounds must be expected.

The protective compositions based on water-glass hitherto employed as an alternative in vacuum carburization plants tend to become brittle and flake off during high-pressure gas quenching. The treatment plants then become contaminated. The heat exchangers can thus become covered with particles, or the fan bearing can be damaged, which can lead to a plant shut-down.

Therefore, an object of the present invention was to discover and develop hardening protection compositions for partial carburization of metallic components which do not have the disadvantages of the known products.

SUMMARY OF THE INVENTION

The above and other objects of the present invention can be achieved by addition of magnesium-silicon compounds to hardening protection compositions which are otherwise composed in a known manner and are based on substances which form boron glass. An advantage of the present invention is that the risk of running off of substance and the vapour pressure can be reduced drastically.

The present invention therefore provides hardening protection compositions based on substances which form boron glass for partial carburization of metallic components, which are characterized in that they comprise magnesium-silicon compounds as an additive.

By the addition according to the invention of magnesium-silicon compounds, an increased reliability against incorrectly isolated areas due to the protective composition running off is achieved in gas carburization.

An increased life of the oven lining is furthermore achieved, and the use of protective compositions based on substances which form boron glass in vacuum carburization is rendered possible.

All inorganic magnesium-silicon compounds are in principle suitable as the additive according to the invention for the hardening protection compositions based on substances which form boron glass. Typical compounds which are suitable for this use are magnesium silicates, such as, for example, magnesium orthosilicate ($Mg_2SiO_4$), magnesium metasilicate ($MgSiO_3$), magnesium trisilicate ($Mg_2Si_3O_8$) and talc. Magnesium trisilicate is particularly preferred.

DETAILED EMBODIMENTS OF THE INVENTION

The hardening protection compositions according to the invention typically comprise substances which form boron glass and magnesium-silicon compounds in a weight ratio of 2:1 to 100:1. A weight ratio of substances which form boron glass to magnesium-silicon compounds of 5:1 to 15:1 is preferred, in particular approximately 10:1.

The hardening protection compositions according to the invention comprise boric acid, boron oxide, alkali metal and/or alkaline earth metal borates as substances which form boron glass.

The hardening protection compositions of this invention comprise three essential main components; (a) the active ingredient or active ingredient system, (b) an organic binder system that enables the coating of the surface to be protected through application, dipping or spraying, and (c) auxilliary agents that assist and help in imposing the handling and treatment during preparation, as well as improving storage characteristics. Organic binder systems that can be used according to the invention are film forming organic polymers which are soluble in organic solvents or dispersible in water. Preferred binder systems are based on acrylic resins dissolved in xylol or butylacetate.

The hardening protection compositions according to the invention can comprise, based on the total amount, 35–70 wt. % of an organic binder system and can be formulated in a liquid, semi-liquid or paste-like consistency. Suitable binder systems are known per se and familiar to the expert, and correspond to those such as are used in hardening protection compositions which have been employed hitherto in practice.

Typical hardening protection compositions according to the invention comprise, for example, 40–55 wt. % boron oxide, 3–6 wt. % magnesium trisilicate and 39–57 wt. % of an organic binder system, in each case based on the total amount.

The hardening protection compositions according to the invention can be used very advantageously in processes for the partial carburization of metallic components and in particular are outstandingly suitable for vacuum carburization. They are used in a manner which corresponds completely to that for known hardening protection compositions. In contrast to those, however, no running off from the components takes place, so that a defect-free and reliable treatment is ensured. They also cause no contamination of the plants.

EXAMPLE 1

According to the Invention

A protective composition of 50 wt. % boron oxide, 5 wt. % magnesium trisilicate and 45 wt. % of an organic binder system was applied to a component at room temperature and the component was stored for 10 days at elevated atmospheric humidity. Thereafter, the component was carburized at 930° C. for 5 h to a case-hardening depth (chd) of 1.2 mm, quenched in oil and cleaned in an industrial washing machine.

Result of the Treatment:

Exactly the area to be isolated was protected, and there was no running at all of the protective composition. The hardness was 32–36 HRC in the covered area, 61–63 HRC in the unprotected area. The isolation was defect-free. The component could be cleaned without problems in the industrial washing machine.

EXAMPLE 2

Comparison Example

A protective composition of 55 wt. % boron oxide and 45 wt. % of an organic binder system was applied to a component at room temperature and the component was stored for 10 days at elevated atmospheric humidity. Thereafter, the component was carburized at 930° C. for 5 h to a chd of 1.2 mm, quenched in oil and cleaned in an industrial washing machine.

Result of the Treatment:

There were several runs which are to be attributed to flow of the protective composition during the treatment. The hardness was mostly 32–36 HRC in the covered area, 49–55 HRC in the area of the runs, 61–63 HRC in the unprotected area outside the runs. The isolation was defective, and the component was therefore unusable.

EXAMPLE 3

According to the Invention

A protective composition of 50 wt. % boron oxide, 5 wt. % magnesium trisilicate and 45 wt. % of an organic binder system was applied to a component at room temperature and dried for 10 hours at room temperature. Thereafter, the component was carburized in a reduced pressure carburization plant to a chd of 0.6 mm, quenched in a cold chamber and cleaned in an industrial washing machine.

Result of the Treatment:

Exactly the area to be isolated was protected, and there was no running at all of the protective composition. The protective composition did not flake off during the quenching. The hardness was 31–33 HRC in the covered area, 61–63 HRC in the unprotected area. The isolation was defect-free. The component could be cleaned without problems in the industrial washing machine.

EXAMPLE 4

Comparison Example

A protective composition of 55 wt. % boron oxide, and 45 wt. % of an organic binder system was applied to a component at room temperature and dried for 10 hours at room temperature.

Thereafter, the component was carburized in a reduced pressure carburization plant to a chd of 0.6 mm, quenched in a cold chamber and cleaned in an industrial washing machine.

Result of the Treatment:

There were several runs which are to be attributed to flow of the protective composition during the treatment. The hardness was mostly 31–34 HRC in the covered area, 47–54 HRC in the area of the runs, 61–63 HRC in the unprotected area outside the runs. The isolation was defective, and the component was therefore unusable.

EXAMPLE 5

Comparison Example

A protective composition based on water-glass was applied to a component at room temperature and dried for 10 hours at room temperature. Thereafter, the component was carburized in a reduced pressure carburization plant to a chd of 0.6 mm, quenched in a cold chamber and cleaned in an industrial washing machine.

Result of the Treatment:

There were no runs, and the hardness was 29–32 HRC in the covered area, 61–63 HRC in the unprotected area. Partial flaking off of the protective composition of about 20% of the composition applied was to be found during the quenching. The residues of the protective composition which had flaked off were hard and could be removed from the quenching chamber, in particular from the heat exchangers, only with a very great outlay. As a result of these particles remaining in the plant, a shortening of the running time of the plant and a deterioration in functioning are to be expected. The residues of the protective composition could not be washed off in the industrial washing machine. It was possible to clean the component only by blasting with sand or glass beads.

Further variations and modifications of the foregoing will be apparent to those skilled in the art and are intended to be encompassed by the claims appended hereto.

German priority application 100 38 447.1 is relied on and incorporated herein by reference.

We claim:

1. A process for treating a portion of a surface of a metal substrate, by carburization, nitrocarburization and nitriding, comprising applying to a different portion of the surface of the metal substrate, a composition which is in liquid, semi-liquid or paste form and comprises a source of boron which forms boron glass, during said treating;

a magnesium-silicon compound selected from the group consisting of magnesium orthosilicate ($Mg_2SiO_4$), magnesium metasilicate ($MgSiO_3$), and magnesium trisilicate ($Mg_2Si_3O_8$), wherein the source of boron glass and the magnesium-silicate compound are present in a weight ratio of 2:1 to 100:1, and wherein the magnesium silicon compound reduces the vapor pressure of boron and wherein the boron glass is soluble in water.

2. The process of claim 1, which further comprises allowing the composition to dry on the said different portion of said surface.

3. The process of claim 1, wherein the source of boron forms a boron glass on said different portion of said surface.

4. The process of claim 1, which comprises washing the boron glass from said surface, after treating by said carburization, nitrocarburization or nitriding treatment.

5. The process of claim 1, wherein conditions, of carburization, nitrocarburization and nitriding, further comprise a temperature ranging from 900–980° C.

6. The process of claim 1, wherein any one of said carburization, nitrocarburization or nitriding, is undertaken under reduced pressure.

7. The process of claim 1, wherein the composition further comprises 35–70 weight percent of an organic binder.

8. The process of claim 7, wherein the magnesium silicon compound is magnesium trisilicate.

9. In a process for carburizing a surface of a metal substrate, in a reduced pressure carburization plant, the improvement comprising decreasing the damage to the oven surfaces comprising $SiO_2$, the improvement comprising applying to a different portion of the substrate, a composition in the form of a liquid, semi-liquid or paste which comprises a source of boron which forms boron glass, during said treating;

a magnesium-silicon compound selected from the group consisting of magnesium orthosilicate ($Mg_2SiO_4$), magnesium metasilicate ($MgSiO_3$), and magnesium trisilicate ($Mg_2Si_3O_8$), wherein the source of boron glass and the magnesium-silicate compound are present in a weight ratio of 2:1 to 100:1, and wherein the magnesium silicon compound reduces the vapor pressure of boron and wherein the boron glass is soluble in water.

10. A composition, for protecting a portion of a metal surface during surface treatment of another portion of the metal surface, wherein the surface treatment is selected from the group consisting of carburization, nitrocarburization and nitriding, wherein said treatment is conducted at high temperature, at reduced pressure or both, the improvement wherein the composition is in a paste, semi-liquid or liquid form and comprises an organic binder, a source of boron which forms boron glass and a magnesium-silicon compound selected from the group consisting of magnesium orthosilicate ($Mg_2SiO_4$), magnesium metasilicate ($MgSiO_3$), and magnesium trisilicate ($Mg_2Si_3O_8$), wherein the source of boron and the magnesium silicon compound are present in a weight ratio of 2:1 to 100:1, wherein the magnesium silicon compound reduces the vapor pressure of boron and wherein the boron glass is soluble in water.

11. The composition of claim 10, wherein the magnesium silicon compound is magnesium trisilicate.

12. The composition of claim 10 wherein the composition further comprises 35–70 weight percent of an organic binder.

13. The composition of claim 11, wherein the composition further comprises 35–70 weight percent of an organic binder.

14. The composition according to claim 10 wherein the substance which forms boron glass and the magnesium-silicon compound are present in a weight ratio of 5:1 to 15:1.

15. The hardening protection composition according to claim 10 comprising, based on the total amount, 45 wt. % boron oxide, 5 wt. % magnesium trisilicate and 50 wt. % of an organic binder.

* * * * *